US007991345B2

(12) United States Patent
Yamamoto

(10) Patent No.: US 7,991,345 B2
(45) Date of Patent: Aug. 2, 2011

(54) IMAGE FORMING APPARATUS

(75) Inventor: Masakazu Yamamoto, Osaka (JP)

(73) Assignee: Kyocera Mita Corporation (JP)

( * ) Notice: Subject to any disclaimer, the term of this patent is extended or adjusted under 35 U.S.C. 154(b) by 933 days.

(21) Appl. No.: 11/764,443

(22) Filed: Jun. 18, 2007

(65) Prior Publication Data

US 2008/0001340 A1 Jan. 3, 2008

(30) Foreign Application Priority Data

Jun. 30, 2006 (JP) ..... 2006-180728

(51) Int. Cl.
*G03G 15/00* (2006.01)
*G03G 21/00* (2006.01)

(52) U.S. Cl. ..... 399/382; 399/407

(58) Field of Classification Search ..... 399/407–411, 399/382

See application file for complete search history.

(56) References Cited

U.S. PATENT DOCUMENTS

2003/0106637 A1* 6/2003 Kimble ..... 156/277
2006/0228137 A1* 10/2006 Steele ..... 399/382
2006/0262348 A1* 11/2006 Aoki et al. ..... 358/1.15

FOREIGN PATENT DOCUMENTS

JP 61-192662 8/1986
JP 5-268408 10/1993
JP 2005-89112 A 4/2005

* cited by examiner

*Primary Examiner* — Daniel J Colilla
*Assistant Examiner* — 'Wyn' Q Ha
(74) *Attorney, Agent, or Firm* — Ostrolenk Faber LLP

(57) ABSTRACT

An image forming apparatus includes a printing unit that executes print jobs in which images are printed on sheets; a sheet discharge tray that receives the printed sheets and partition sheets that partition the printed sheets; a transport unit that discharges the printed sheets and the partition sheets to the sheet discharge tray; a clock that measures the time; and a partition unit that controls the transport unit to discharge the partition sheet during the first interval between print jobs after a predetermined period of time based on the measurement results of the clock.

9 Claims, 15 Drawing Sheets

IMAGE FORMING APPARATUS

CROSS-REFERENCE TO RELATED APPLICATIONS

This application claims priority to Japanese Patent Application No. 2006-180728 filed on Jun. 30, 2006. The entire disclosure of Japanese Patent Application No. 2006-180728 is hereby incorporated herein by reference.

BACKGROUND OF THE INVENTION

1. Field of the Invention

The present invention generally relates to an image forming apparatus. More specifically, the present invention relates to an image forming apparatus such as a photocopier, printer, or multi-function printer that is shared and used by many users via a network 2. Background Information In recent years image forming apparatuses such as printers, photocopiers, and so on, have become a necessity within companies and elsewhere. Also, generally a single image forming apparatus is shared among and used by several users via a network such as a local area network (LAN) or the like. It is not uncommon for one image forming apparatus to be shared by more than 30 people.

In these circumstances documents printed by several users become mixed and accumulate in the sheet discharge tray of the image forming apparatus. This can occur when several print jobs occur at almost the same time, or when users do not quickly take their printed documents.

When this situation occurs, each user must spend time finding and retrieving his/her printed document from among the accumulated printed documents. When more than 30 users share a single image forming apparatus as described above, several hundred pages of printed documents can become accumulated in the sheet discharge tray, so finding and retrieving one's own printed document can require a large amount of time.

Therefore, to solve this type of situation, technology has been disclosed in, for example, Japanese Patent Application Laid-open No. 2005-89112, in which every time a print job is printed an index is printed, or a tab is provided in the sheets. Here, an index is, as shown in FIG. 19 for example, provided on a sheet by printing with the user's name only printed at the top edge (within the circle C1). Also, a tab is, as shown in FIG. 18 for example, an external caption provided on the top edge of the sheet (within the circle C2), within which the user's name or similar is printed. Using these indexes or tabs, users can select their own printed documents from among many accumulated printed documents.

However, the conventional art as described above has the following problem points.

First, the technology for applying the tabs as described above requires providing hardware resources within the image forming apparatus for applying the tabs. However, providing the hardware resources in this way has the problems that the size of the apparatus is increased, and the apparatus is made more complex.

Next, a problem point with the technology for printing indexes is the cost of sheets for printing. In other words, every time a print job is executed as described above, an index is printed. When only three documents, for example, are accumulated in the sheet discharge tray, each user can easily retrieve his/her own printed documents without printing indexes. However, in the conventional art as described above, three index pages would be printed, which is a waste of sheets.

In view of the above, it will be apparent to those skilled in the art from this disclosure that there exists a need for an improved image forming apparatus. This invention addresses this need in the art as well as other needs, which will become apparent to those skilled in the art from this disclosure.

SUMMARY OF THE INVENTION

With the foregoing problem points of conventional art in mind, it is an object of the present invention to provide an image forming apparatus for which each user can easily retrieve his/her own printed documents from the sheet discharge tray without increasing the size of the apparatus or making the apparatus more complex and without increasing the cost of the sheets.

To achieve the above object, an image forming apparatus according to a first aspect of the present invention includes a printing unit, a sheet discharge tray, a transport unit, a clock, and a partition unit. The printing unit executes print jobs in which images are printed on sheets. The sheet discharge tray receives the printed sheets and partition sheets that partition the sheets. The transport unit discharges the printed sheets and the partition sheets to the sheet discharge tray. The clock measures the time. The partition unit controls the transport unit to discharge a partition sheet during the first interval between print jobs after a predetermined period of time based on the measurement results of the clock.

An image forming apparatus according to a second aspect of the present invention includes a printing unit, a sheet discharge tray, a transport unit, a counter, and a partition unit. The printing unit executes print jobs in which images are printed on sheets. The sheet discharge tray receives the printed sheets and partition sheets that partition the sheets. The transport unit discharges the printed sheets and the partition sheets to the sheet discharge tray. The counter counts the number of sheets discharged to the sheet discharge tray. The partition unit controls the transport unit to discharge a partition sheet to the sheet discharge tray during the first interval between print jobs after the measurement result of the counter has reached a predetermined number.

An image forming apparatus according to a third aspect of the present invention includes a printing unit, a sheet discharge tray, a transport unit, a clock, and a partition unit. The printing unit executes print jobs in which images are printed on sheets. The sheet discharge tray receives the printed sheets and partition sheets that partition the sheets. The transport unit discharges the printed sheets and the partition sheets to the sheet discharge tray. The clock measures the time. The partition unit controls the printing unit to print a predetermined time on the first sheet used in the first print job after the predetermined time has arrived based on the measurement results of the clock.

An image forming apparatus according to a fourth aspect of the present invention includes a printing unit, a sheet discharge tray, a transport unit, a counter, a clock, and a partition unit. The printing unit executes print jobs in which images are printed on sheets. The sheet discharge tray receives the printed sheets and partition sheets that partition the sheets. The transport unit discharges the printed sheets and the partition sheets to the sheet discharge tray. The counter counts the number of sheets discharged to the sheet discharge tray. The clock measures the time. The partition unit controls the printing unit to print the current time on the first sheet used in the first print job after the measurement result of the counter reaches a predetermined number.

An image forming apparatus according to a fifth aspect of the present invention includes a printing unit, a sheet discharge tray, a transport unit, a counter, a clock, and a partition unit. The printing unit executes print jobs in which images are printed on sheets. The sheet discharge tray receives the printed sheets and partition sheets that partition the sheets. The transport unit discharges the printed sheets and the partition sheets to the sheet discharge tray. The counter counts the number of sheets discharged to the sheet discharge tray. The clock measures the time. The partition unit controls the printing unit to print the current time on the first sheet used in the first print job after the measurement results of the counter reach a predetermined number and after the arrival of a predetermined time based on the measurement results of the clock and the counter.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents. In the following, a printing apparatus is explained as an example of an image forming apparatus. However, the present invention is not limited to this, but may be applied to other image forming apparatus, such as photocopiers, and multi-function printers.

[1] Structure of the Printing Apparatus

Figure 1:
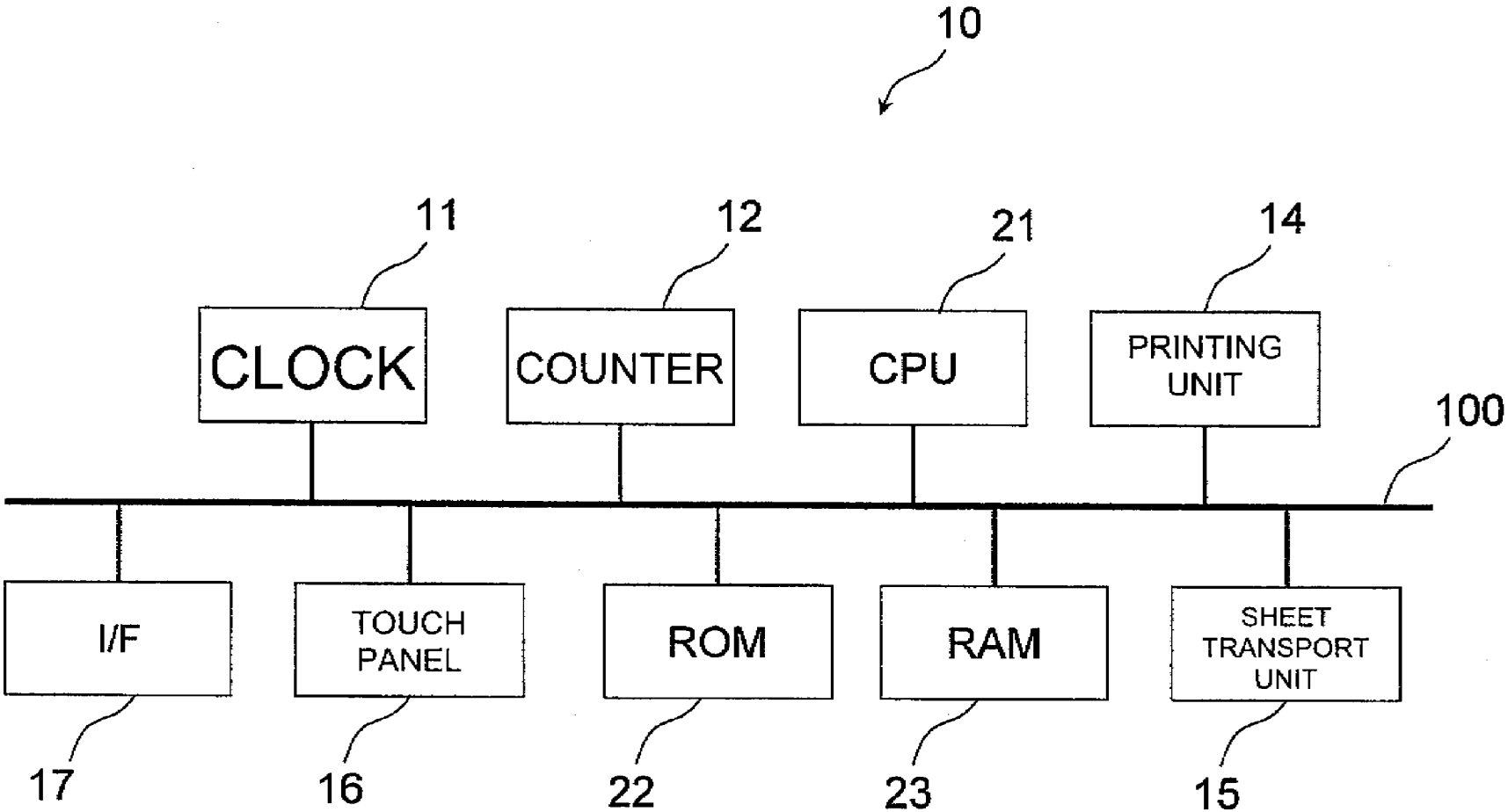
FIG. 1 is a view of a block diagram showing main hardware parts in a printing apparatus according to a preferred embodiment of the present invention.
Figure 2:
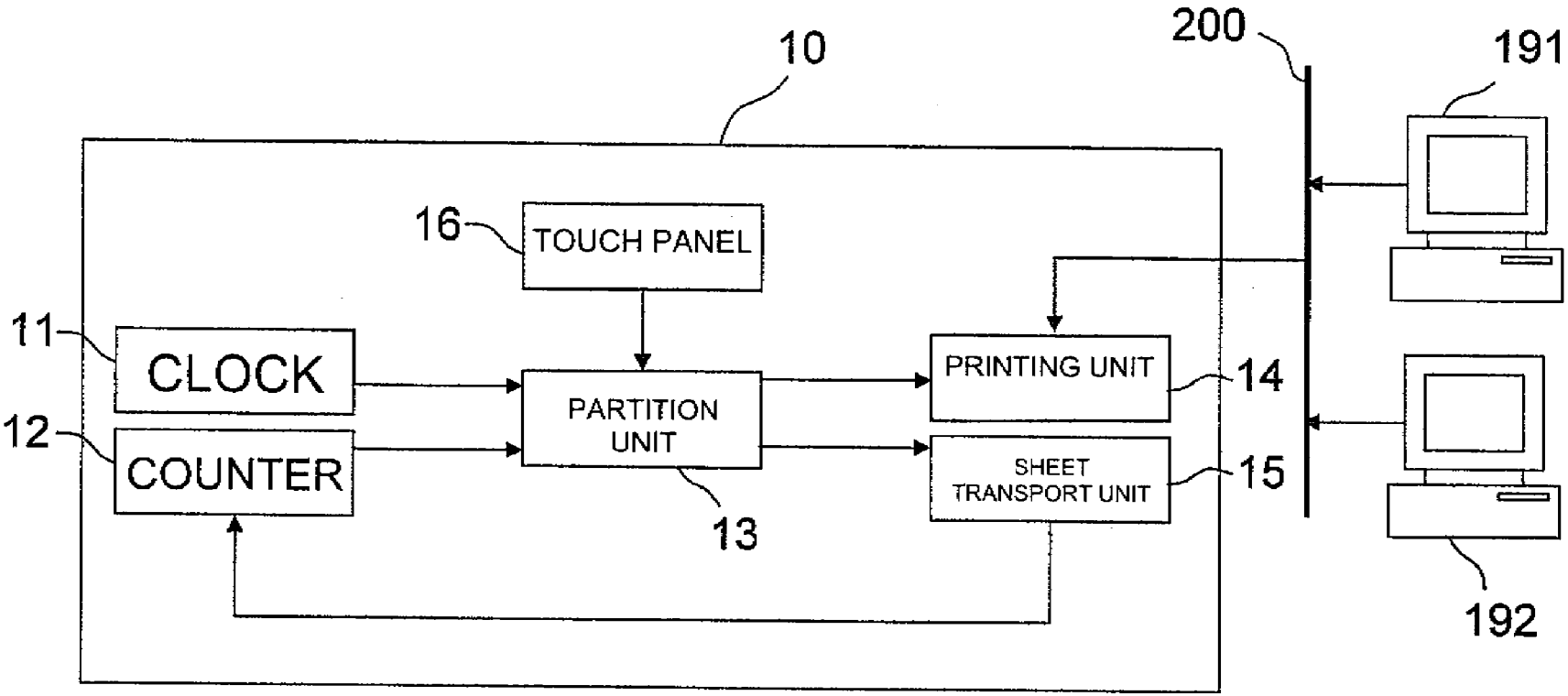
FIG. 2 is a view of a block diagram showing the flow of signals when the above printing apparatus receives print jobs from external apparatus.
Figure 3A:
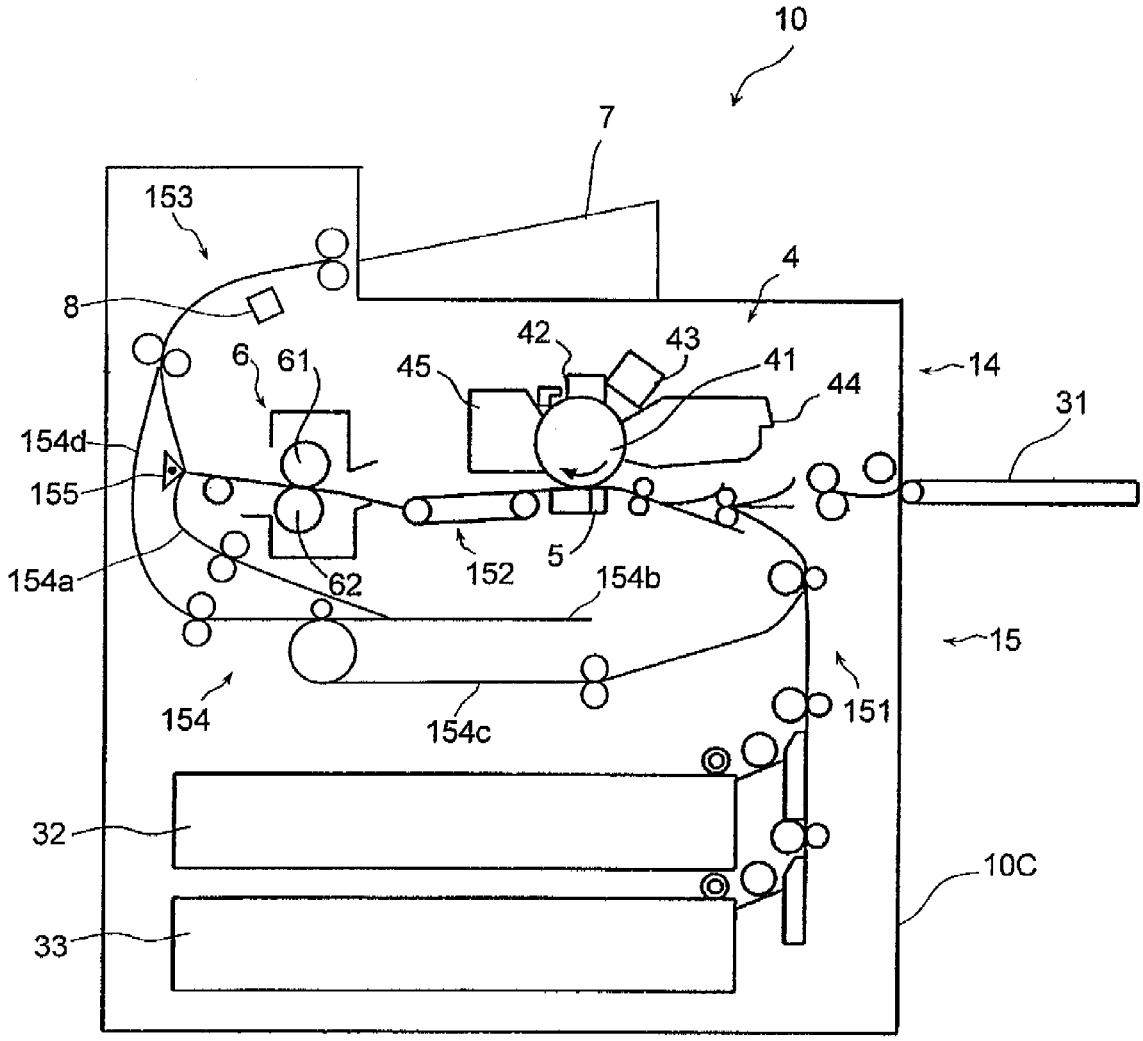
FIG. 3A is a front cross-sectional view showing the specific structure of the interior of the printing apparatus.
Figure 3B:
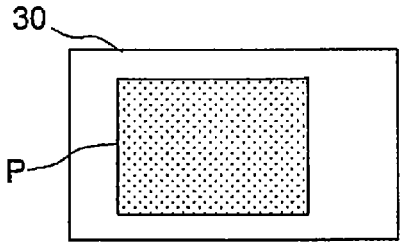
FIG. 3B is a view of a diagram showing a printed document produced by the printing apparatus.
Figure 3C:
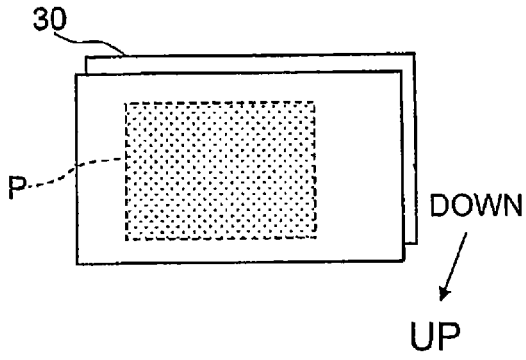
FIG. 3C is a view of a diagram showing a bundle of printed documents in a sheet discharge tray of the printing apparatus.

FIG. 1 is a view of a block diagram showing the main hardware configuration of a printing apparatus 10 according to the present embodiment. FIG. 2 is a view of a block diagram showing the flow of signals when the printing apparatus 10 receives printing jobs. FIG. 3A is a front cross-sectional view showing the specific structure of the interior of the printing apparatus 10. FIG. 3B is a view of a diagram showing a printed document produced by the printing apparatus 10. FIG. 3C is a view of a diagram showing a bundle of printed documents in the sheet discharge tray of the printing apparatus 10.

As shown in FIG. 1 and FIG. 2, the printing apparatus 10 includes a clock 11, a counter 12, a printing unit 14, a sheet transport unit 15, a touch panel 16, an I/F (interface) 17, a central processing unit (CPU) 21, a read only memory (ROM) 22, and a random access memory (RAM) 23. The clock 11 measures the time. The counter 12 is configured to count the number of sheets (number of sheets discharged) of printed documents discharged to a sheet discharge tray 7 that is described below. The printing unit 14 executes print jobs received via external apparatus or via the touch panel 16 that is described below. The sheet transport unit 15 supplies sheets to the printing unit 14, and finally discharges the sheets to the sheet discharge tray 7 that is described below. The touch panel 16 receives instructions and other input from users. The I/F (interface) 17 transmits and receives data to and from external devices via a communication network 200. The central processing unit (CPU) 21 carries out all types of calculations, controls each part of the printing apparatus, and so on. The read only memory (ROM) 22 stores control programs executed by the CPU 21. The random access memory (RAM) provides work space for the CPU 21. The printing apparatus 10 further includes a bus 100, to which the members described above are connected.

As external devices to which the printing apparatus 10 can be connected via the communication network 200, FIG. 2 shows only personal computers 191 and 192, however, the printing apparatus 10 can communicate with apparatuses other than these apparatuses.

As shown in FIG. 2, the printing apparatus 10 includes a partition unit 13. The partition unit 13 is formed by the CPU 21, the ROM 22, and the RAM 23, and is realized by the CPU 21 expanding a program stored in the ROM 22 into the RAM 23.

As shown in FIG. 3A, the printing apparatus 10 includes a housing 10C, and the printing unit 14, the sheet transport unit 15, and other members are provided within the housing 10C. A manual feed tray 31 is provided on the external side surface of the housing 10C, and the sheet discharge tray 7 is provided in the top surface of the housing 10C. Sheet supply cassettes 32 and 33 are further provided within the housing 10C. In the following, the manual feed tray 31 and the sheet supply cassettes 32 and 33 are collectively referred to as the sheet storage unit.

In the present embodiment, the printing unit 14 uses an electrophotographic printing mechanism. The printing unit 14 includes a developing unit 4, a transfer unit 5, and a fixing unit 6. The present invention is not limited to this, and instead of the printing unit 14 in the present embodiment, another printing mechanism, such as the inkjet method, and so on, may be used as appropriate. Also, besides the members that form the printing mechanism, the printing unit 14 includes a drive unit that drives these members, a control unit that controls the operation of the drive unit, and so on.

The developing unit 4 includes a photosensitive drum 41 that can rotate in the direction of the arrow. The developing unit 4 also includes disposed around the photosensitive drum 41 in the direction of rotation, a charging unit 42 that uniformly charges the photosensitive drum 41, a light exposure unit 43 that forms electrostatic latent images with light on the charged surface of the photosensitive drum 41 corresponding to image data transmitted by the CPU 21, a developing unit 44 that develops the electrostatic latent images with toner to form toner images, and a cleaning unit 45 that removes any toner remaining on the surface of the photosensitive drum 41 after transfer.

The transfer unit 5 is disposed between the developing unit 44 and the cleaning unit 45, and in opposition to the photosensitive drum 41. The transfer unit 5 transfers the toner image on the photosensitive drum 41 onto a sheet supplied by the sheet transport unit 15.

The fixing unit 6 includes a heating roller 61 and a roller 62 in opposition to the heating roller 61. The fixing unit 6 fixes toner images to sheets onto which toner images have been transferred by the transfer unit 5 by applying heat and pressure.

The sheet transport unit 15 is divided into a sheet supply unit 151 that supplies sheets from the sheet storage unit (31 through 33) to the printing unit 14, an intermediate transport unit 152 that transports sheets from the developing unit 4 to the fixing unit 6, a sheet discharge unit 153 that discharges sheets to the sheet discharge tray 7 after fixing, and a reversal unit 154 that reverses the sheets when carrying out double sided printing.

The sheet supply unit 151, the intermediate transport unit 152, the sheet discharge unit 153, and the reversal unit 154 include groups of rollers that move the sheets, transport belts that guide the sheets that are moved by the groups of rollers, and so on.

The groups of rollers include in particular in the sheet supply unit 151 pick up rollers that draw out sheets from the sheet storage unit (31 through 33), separation rollers that separate the drawn out sheets one sheet at a time, and transport rollers that transport the separated sheets to the printing unit 14. Also, the intermediate transport unit 152 includes a plurality of transport rollers that transport sheets supplied by the sheet supply unit 151 through the printing unit 14 and fixing unit 6 to the sheet discharge unit 153. Also, the sheet discharge unit 153 includes discharge rollers that finally discharge sheets in the sheet discharge unit 153 to the sheet discharge tray 7.

The reversal unit 154 includes a branch path 154*a*, a sheet holding unit 154*b*, a return flow path 154*c*, and a subsidiary transport path 154*d*. The branch path 154*a* branches from the sheet discharge unit 153. The sheet holding unit 154*b* temporarily holds sheets fed in via the branch path 154*a*. The return flow path 154*c* returns sheets in the sheet holding unit 154*b* to the sheet supply unit 151 with the rear edge when transported into the sheet holding unit 154*b* as the leading edge. The subsidiary transport path 154*d* transports sheets in the sheet holding unit 154*b* to the sheet discharge unit 153 with the rear edge of the sheet transported into the sheet holding unit 154*b* as the leading edge. Rollers are disposed within the reversal unit 154 as appropriate to transport sheets. Also, a switch 155 is provided at the branch point between the sheet discharge unit 153 and the branch path 154*a*. The switch 155 can be controlled by the CPU 21 to switch sheets between the sheet discharge unit 153 and the branch path 154*a*.

When executing one sided printing, the sheet supply unit 151 supplies a sheet to the printing unit 14, the printing unit 14 prints an image P on the upward facing side (the first side) of the two sides of the sheet, to create a printed document 30 (FIG. 3B). After receiving a printed sheet from the intermediate transport unit 152, the sheet discharge unit 153 discharges the printed document to the sheet discharge tray 7. At this time, as shown in FIG. 3C, the printed documents are discharged into the sheet discharge tray 7 with the first side facing down. Also, if several pages of a printed document are produced by one print job, the printing unit 14 prints the first page, second page, third page, etc., until the final page, in that order. Also, each printed page is discharged to the sheet discharge tray 7 in the order first page, second page, etc., with subsequent pages being discharged on top. For convenience of explanation, the image P is shown with a dotted line in FIG. 3C.

On the other hand, when printing double sided documents, after the image has been printed on the first side, the sheet passes through the fixing unit 6, and is transported to the sheet holding unit 154*b* via the branch path 154*a*. By returning the sheet to the sheet supply unit 151 from the reversal unit 154 via the return flow path 154*c*, the sheet is reversed both vertically as well as forward and back relative to when the first side was printed. After the image has been printed on the second side by the printing unit 14, the sheet is again transported to the sheet holding unit 154*b* via the branch path 154*a*. When the sheet that has been printed on both the first and second sides is returned to the sheet discharge unit 153, the sheet is again reversed both vertically and in the forward and reverse direction. In other words, the printed documents are discharged to the sheet discharge tray 7 with the same orientation as when carrying out single sided printing, namely the first side is facing down.

Referring now to FIGS. 2 and 3A, to obtain the number of sheets discharged, the printing apparatus 10 includes a counter 12, and a sensor 8 that detects sheets transported by the sheet discharge unit 153. A commonly known sensor, such as an optical sensor, a magnetic sensor, or a contact sensor, is preferably used as the sensor 8. The counter 12 counts the number of sheets discharged in accordance with the detection of sheets by the sensor 8.

Besides the sheet discharge unit 153, the sensor 8 may be disposed in the sheet supply unit 151, the intermediate transport unit 152, or elsewhere.

Also, apart from using a sensor 8, it is possible for the counter 12 to obtain the number of sheets discharged from, for example, the number of revolutions of the sheet discharge rollers or the pick up rollers, or from the number of times each part of the sheet transport unit 15 has operated, or similar. Also, it is possible for the counter 12 to obtain the number of sheets of printed document arising in each print job from information in the CPU 21 for each individual print job.

[2] Partitioning Operation

Each print job transmitted to the printing apparatus 10 from the PC 191 or 192 is executed in turn by the printing unit 14. Printed documents are created by the printing unit 14 executing print jobs. Then the printed documents produced are discharged in turn into the sheet discharge tray 7, and accumulate in the sheet discharge tray 7.

The printing apparatus 10 is capable of partitioning documents in the sheet discharge tray 7 using partition sheets, based on specific partitioning conditions.

[2-1] When the Partitioning Condition is the Arrival of a Predetermined Time

First, a case is explained in which the partitioning condition is the arrival of a predetermined time.

The clock 11 within the printing apparatus 10 notifies the partitioning unit 13 of the time measured. When the partition unit 13 determines from the notification of the clock 11 that a predetermined time has arrived, the sheet transport unit 15 is controlled to discharge a partition sheet to the sheet discharge tray 7.

Figure 4:
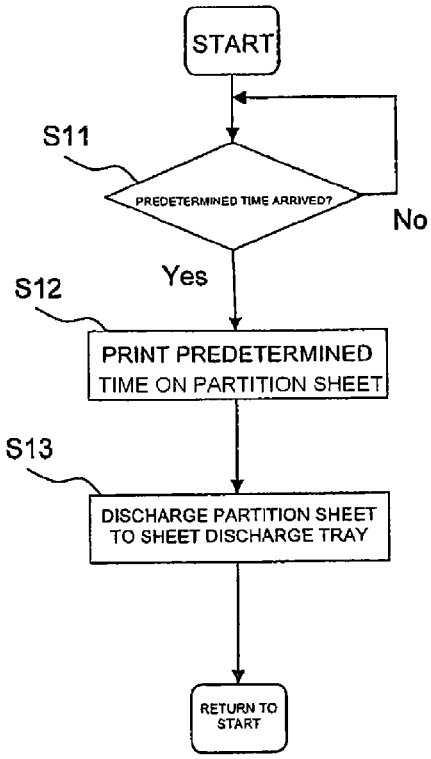
FIG. 4 is a view of a flowchart showing an example of a partitioning operation in the printing apparatus.
Figure 5:
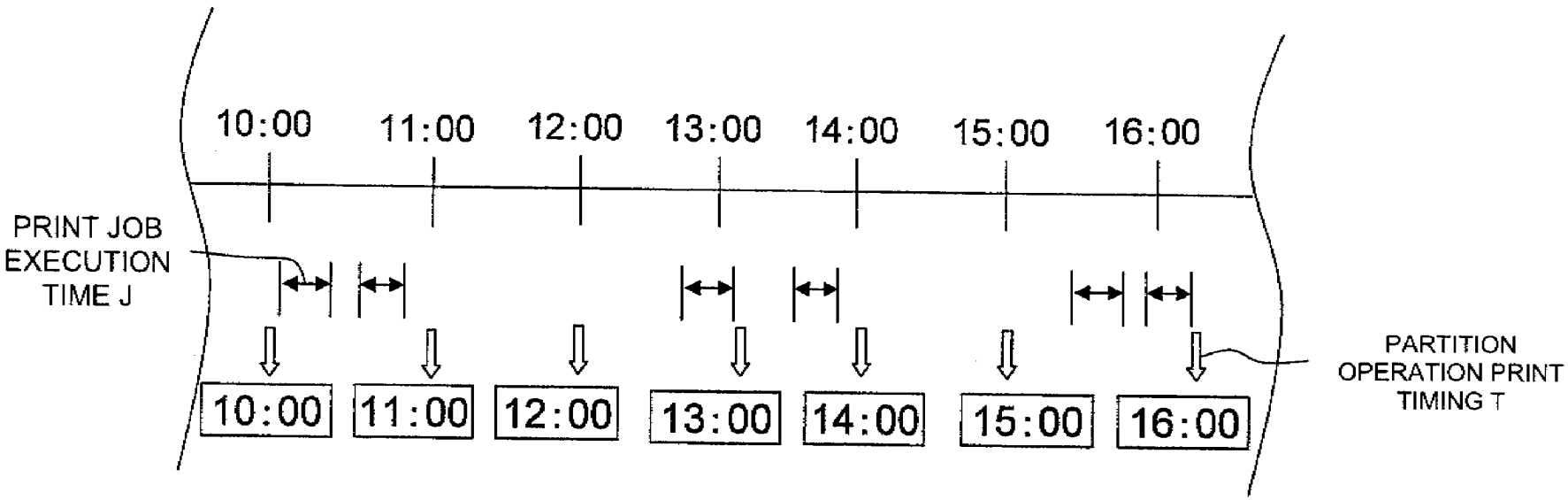
FIG. 5 is a view of a diagram showing an example of the timing of execution of printing the partition sheet.
Figure 6A:
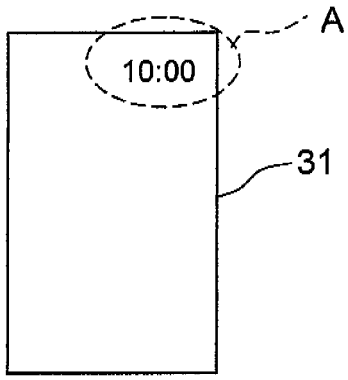
FIG. 6A is a view of a diagram showing an example of partition sheet printed at the timing shown in FIG. 5.
Figure 6B:
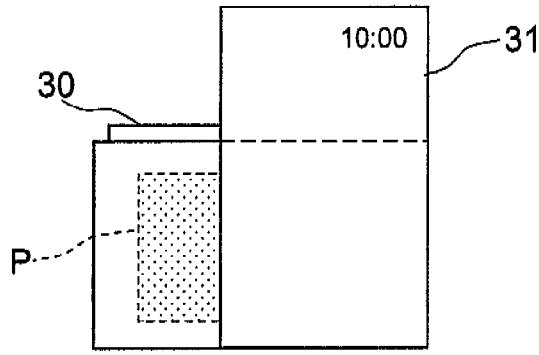
FIG. 6B is a view of a diagram showing the positional relationship between the partition sheets and the normal printed documents in the sheet discharge tray.
Figure 7:
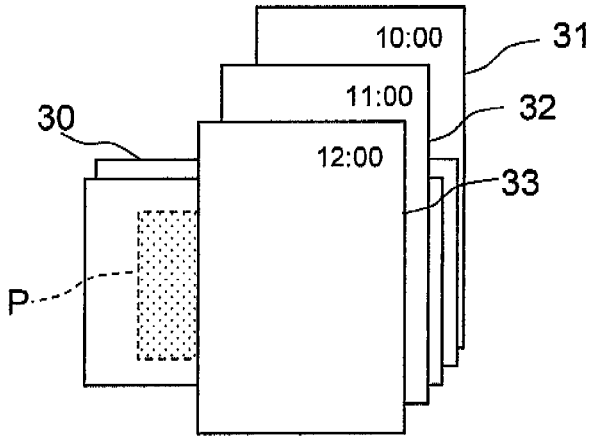
FIG. 7 is a view of a diagram showing an example of a bundle of sheets that includes normal printed documents with partition sheets inserted between documents, in the sheet discharge tray.

A specific example of the partitioning operation to produce and discharge a partition sheet is explained with reference to FIGS. 4 through 7. FIG. 4 is a view of a flowchart of the partition operation for this example. FIG. 5 is a view of a diagram showing an example of the timing of execution of printing the partition sheet. FIG. 6A is a view of a diagram showing an example of partition sheet printed in the partition operation. FIG. 6B is a view of a diagram showing the positional relationship between the partition sheets and the normal printed documents in the sheet discharge tray 7. FIG. 7 is a view of a diagram showing an example of a bundle of sheets that includes normal printed documents with partition sheets inserted between the documents, in the sheet discharge tray. Along the time axis in FIG. 5, the time of execution of print jobs (two-way arrow symbols) J, the timing of printing of partition sheets (hollow arrow symbols) T, and the time of printing partition sheets (time enclosed within a rectangle) are shown.

When the power to the printing apparatus 10 is turned on, the flow shown in FIG. 4 starts. The partition unit 13 determines whether the predetermined time has arrived from the time measured by the clock 11 (Step S11). If the predetermined time has not arrived, the partition operation is not executed (Step S11: NO). On the other hand, if the predetermined time has arrived, the partition unit 13 instructs the printing unit 14 and the sheet transport unit 15 to produce a partition sheet 31, and to discharge the partition sheet 31 to the sheet discharge tray 7 (Step S11: YES→S12→S13).

When the printing unit 14 receives this instruction, if a print job is not being executed at the time the predetermined time has arrived, the printing unit 14 immediately produces a partition sheet 31 by printing the predetermined time on a sheet supplied by the sheet transport unit 15. On the other hand, if there is a print job being executed at the time that the predetermined time has arrived, the printing unit 14 produces the partition sheet 31 when the print job is finished. In other words, the printing unit 14 puts in abeyance the instruction to produce the partition sheet by printing the time on the sheet, received from the partition unit 13, until the print job being executed is finished, and executes the instruction after the print job being executed is finished.

As shown in FIG. 5, in the present example the predetermined time is at 9:00, 10:00, 11:00, 12:00, and so on, at one hour intervals. As shown in FIG. 5, at 10:00, 11:00, 12:00, 14:00, and 15:00 there are no print jobs being executed, so the printing unit 14 immediately prints the characters "10:00," "11:00," and so on, on the respective sheets. On the other hand, at 13:00 and 16:00, print jobs are being executed, so the printing unit 14 prints "13:00" and "16:00" on the sheets immediately after finishing the print jobs and before starting the next print job, to produce the partition sheets.

Also, in the present example, as shown in FIG. 6A, the partition sheet 31 is a sheet that is used for a normal printing job with the time, such as "10:00" or the like, printed at the top edge of the sheet (within the circle A indicated with a broken line). In hardware terms, this printing is executed by the CPU 21, which receives the signal from the clock 11, creating image data corresponding to the display "10:00", and the printing unit 14 develops these image data.

Referring now to FIGS. 3A and 6B, the sheet discharge unit 153 can discharge the partition sheets 31 printed in this way onto the sheet discharge tray 7 with the position shifted relative to normal sheets after printing (normal printed documents) 30 (FIG. 6B). In this way, by shifting the positions of the partition sheets 31 and the normal printed documents 30, an effect that allows users can to distinguish easily the normal printed documents and partition sheets can be obtained. There is no particular limitation on "shifting the positions," as long as this type of effect is obtained. However, as shown in FIG. 6B, the sheet discharge unit 153 may turn the partition sheets 31 90 degrees relative to the normal printed documents 30.

By repeating the same operation as described above, partition sheets 31, 32, 33 with the time "10:00," "11:00," "12:00," and so on, are inserted between the printed documents 30, as shown in FIG. 7. Therefore, if a user sends a print job to the printing apparatus 10 from his/her own PC 191 or 192, at 11:30, for example, by searching between partition sheets 32 and 33 his/her printed document can be found.

In this way, according to the printing apparatus 10, even if a large quantity of printed documents is accumulated in the sheet discharge tray 7, each user can easily retrieve his/her own printed documents from the sheet discharge tray 7.

Also, the partition unit 13 can be implemented by storing a partition unit program 13 entirely within the ROM 22. Therefore, it is possible to implement the partition unit 13 by software only at very low cost.

In the above, printing partition sheets at one hour intervals was explained. However, this is just an example. If the number of users sharing the printing apparatus 10 is large, it may be necessary to print partition sheets at narrower intervals (for example, every 30 minutes). Therefore the partition unit 13 may be configured so that the predetermined time can be changed in accordance with users' instructions input via the touch panel 16.

In FIG. 6B, the sheet discharge unit 153 turns the partition sheet 31 90 degrees relative to the normal printed documents 30 and discharges the partition sheet 31. By operating the sheet discharge unit 153 in this way, it is possible to distinguish easily the partition sheets from the normal printed documents if the sheets are rectangular, even if the sheets used in printing the partition sheets and the sheets used in normal print jobs are the same. However, the present invention is not limited to this configuration. The printing apparatus 10 may be configured so that when printing a partition sheet, the sheet supply unit 151 supplies the printing unit 14 with sheets whose size, shape, or color are different from those of the sheets used in the normal print jobs. More specifically, the printing apparatus 10 may use the largest size of sheets set in the sheet storage unit (31 through 33) as the partition sheets. Also, if colored sheets, such as red or blue, are set in the printing apparatus 10, they may be effectively used as partition sheets.

Also, in the present embodiment, in order for users to recognize easily the time printed on the partition sheets, the partition sheets are discharged onto the sheet discharge tray 7 with the side on which the time is printed facing up.

Therefore, when executing the partition operation, the printing unit 14 and the sheet transport unit 15 may carry out the same operation for double sided printing. In other words, the printing unit 14 and the sheet transport unit 15 may pass the sheet that is to become the partition sheet through the printing unit 14 without printing the time on the first side, reverse the sheet in the reversal unit 154, print the time on the second side, and discharge the sheet to the sheet discharge tray 7 with the second side facing upward.

Alternatively, when executing the partition operation, the printing unit 14 and the sheet transport unit 15 may print the time on the first side of the sheet that is to become the partition sheet, transfer the sheet to the sheet holding unit 154*b* via the branch path 154*a*, transport the sheet via the subsidiary transport path 154*d*, not returning it to the return flow path 154*c*, and discharge the sheet by the sheet discharge unit 153. In this way, the partition sheet is discharged to the sheet discharge tray 7 with the first side, in other words the side on which the time is printed, facing up.

In the present embodiment, printed documents are discharged with the first side facing down. However, the present invention is not limited to this. Referring to FIGS. 2 and 2A, if the sheet transport unit 15 discharges the sheets into the sheet discharge tray 7 with the first side facing up, then when executing the partition operation the printing unit 14 and the sheet transport unit 15 may print the time on the first side of the sheet, the same as the operation for single sided printing, and discharge the sheet to the sheet discharge tray 7.

In order to discharge a partition sheet every time the predetermined time has arrived, the printing apparatus 10 may determine whether the time obtained by the partition unit 13 from the clock 11 has reached the predetermined time or not, or the clock 11 may be set to notify the partition unit 13 that the predetermined time has arrived, every time the predetermined time has arrived.

As stated above, if a partition sheet is discharged in accordance with the time, it is not essential that the printing apparatus 10 includes the counter 12, the sensor 8, or a mechanism for counting the number of sheets discharged.

[2-2] When a Partition Sheet is Discharged Every Time the Number of Sheets Discharged Reaches a Predetermined Number Next, a case in which the partitioning condition is dependent on the discharge of a fixed number of sheets of normal printed documents, in other words, a case in which the number of sheets of normal printed documents reaches a predetermined number, is explained.

In the present example, the printing apparatus 10 controls the printing unit 14 and the sheet transport unit 15 so that a partition sheet is printed and discharged in accordance with the count result of the counter 12, and apart from the programming of the partition unit 13, the configuration is virtually the same or the same as the configuration described under [2-1] above.

Figure 8:
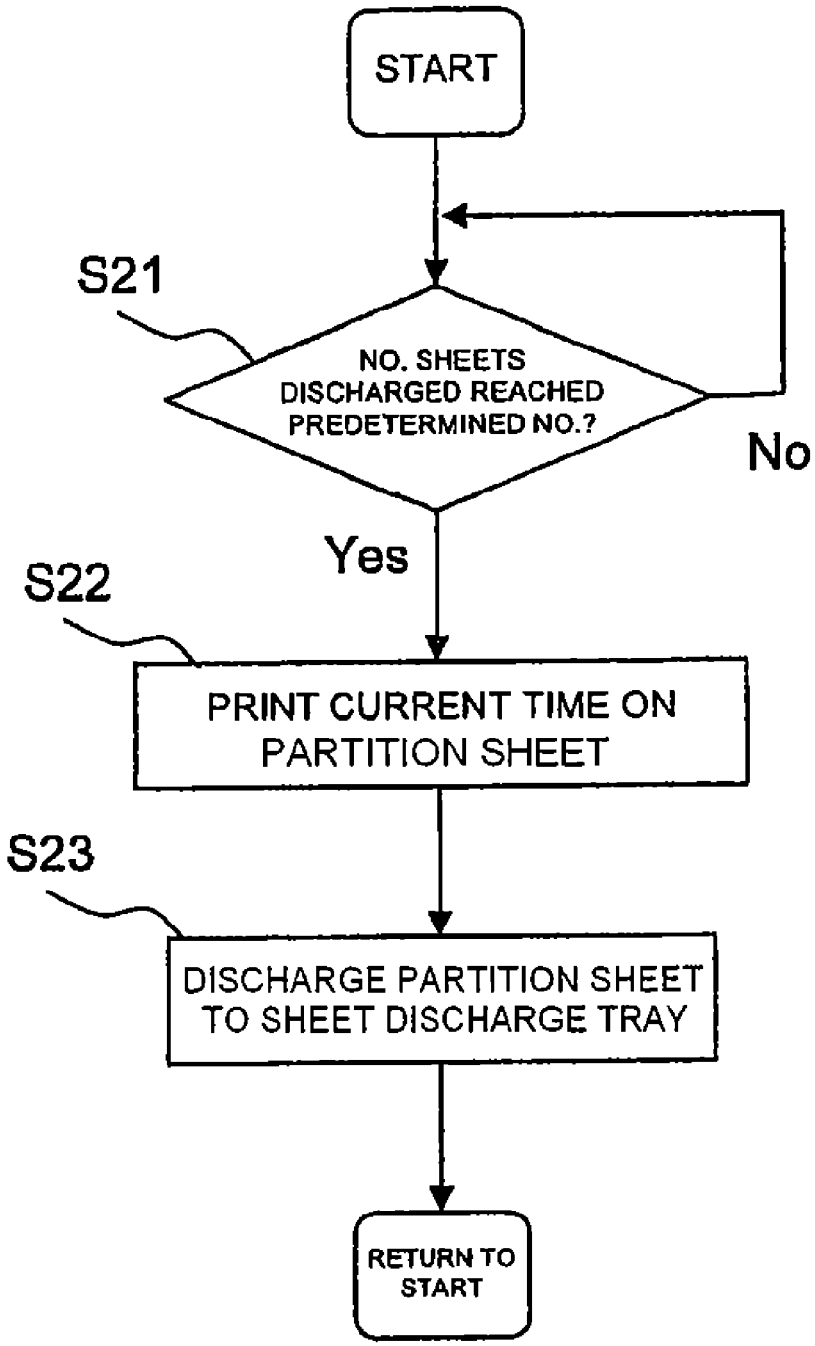
FIG. 8 is a view of a flowchart showing another example of the partitioning operation in the printing apparatus.
Figure 9:
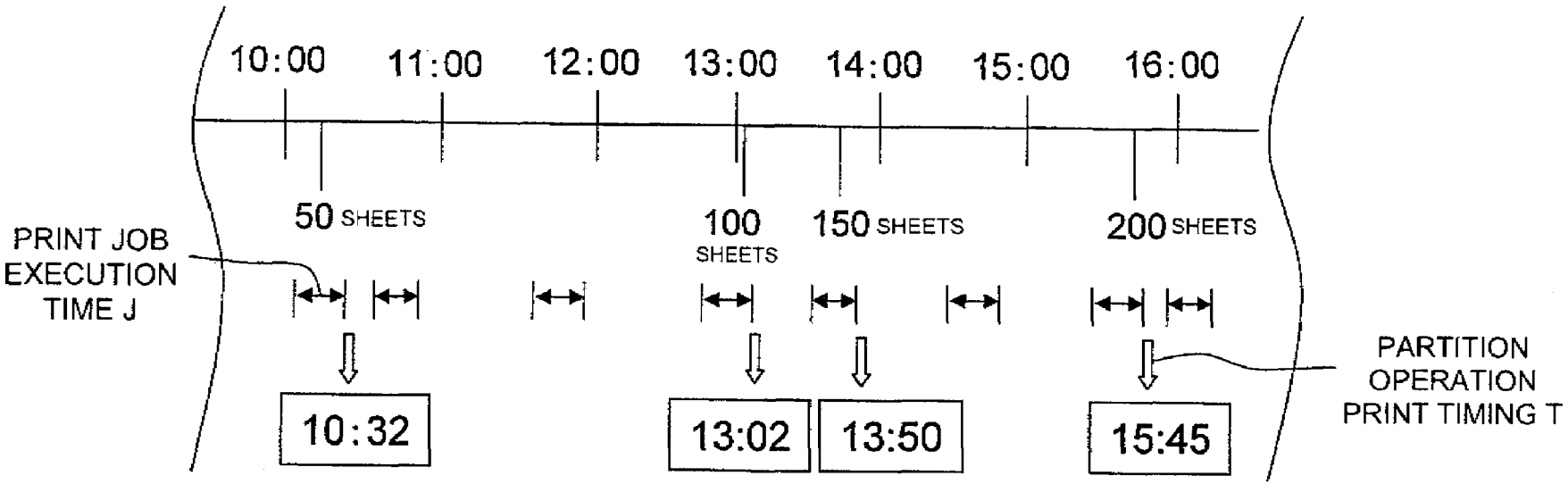
FIG. 9 is a view of a diagram showing the timing of execution of printing the partition sheet in another example.
Figure 10:
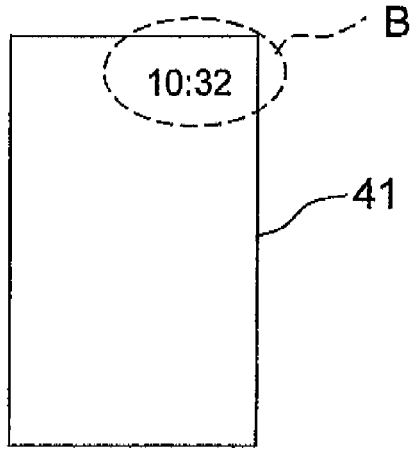
FIG. 10 is a view of a diagram showing an example of partition sheet printed at the timing shown in FIG. 9.
Figure 11:
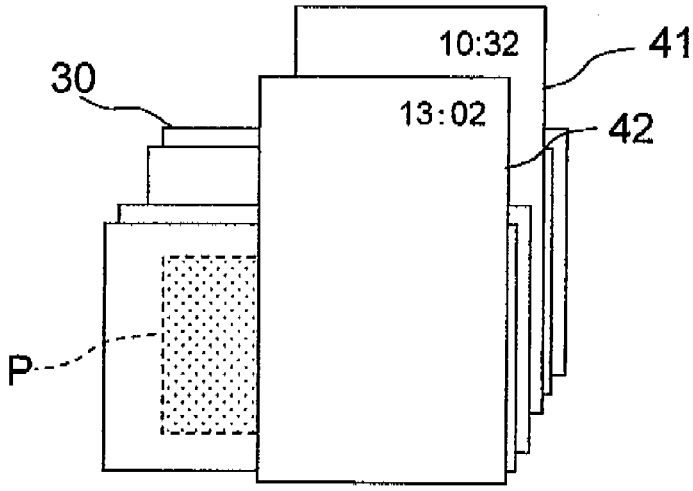
FIG. 11 is a view of a diagram showing an example of a bundle of sheets that includes normal printed documents with partition sheets inserted between documents, in the sheet discharge tray, printed according to the timing shown in FIG. 9.

The partition operation in this example is explained with reference to FIGS. 8 through 11. FIG. 8 is a view of a flowchart of the partition operation for this example. FIG. 9 is a view of a diagram showing an example of the timing of execution of printing the partition sheet. FIG. 10 is a view of a diagram showing an example of partition sheet printed in the partition operation. FIG. 11 is a view of a diagram showing an example of a bundle of sheets that includes normal printed documents with partition sheets inserted between the normal printed documents, printed at the timing shown in FIG. 9. Along the time axis in FIG. 9, the time of execution of print jobs J, the timing of printing of partition sheets T, and the time of printing partition sheets are shown, similar to FIG. 5. In addition the cumulative numbers of sheets discharged are shown. In FIG. 9, the state of use of the printing apparatus 10 (the timing and number of sheets in print job requests) is the same as the example in FIG. 5.

Referring to FIGS. 5 and 8, in the present example, the partition unit 13 controls each unit so that the partition operation is executed when the cumulative count result of the counter 12 reaches 50 sheets, 100 sheets, 150 sheets, and so on, every 50 sheets. Specifically, the partition unit 13 instructs the printing unit 14 and the sheet transport unit 15 to produce a partition sheet and discharge the partition sheet to the sheet discharge tray 7 (Step S21: YES→Step S22→Step S23). If the cumulative count result of the counter 12 has not reached the predetermined number (Step S21: NO), the partition operation is not carried out.

When the printing unit 14 receives this instruction, if a print job is not being executed at the time that the predetermined number of discharged sheets has been reached, a partition sheet 31 is immediately produced by printing the current time on a sheet supplied by the sheet transport unit 15. On the other hand, if there is a print job being executed at the time that the predetermined number of discharged sheets has been reached, the printing unit 14 produces the partition sheet 31 when the print job is finished.

In the example shown in FIG. 9, at the time that the cumulative number of sheets of normal printed documents discharged has reached 50, a print job is being executed. Therefore, after this print job has finished and before the next print job is executed the printing unit 14 prints the time that the partition sheet was printed, "10:32," on the sheet.

Also, in the present example, as shown in FIG. 10, the partition sheet 41 is a sheet that is used for a normal printing job with the time printed at the top edge of the sheet (within the circle B indicated with a broken line), similar to that described in [2-1] above. However, the time at which printing of the partition sheet was executed, "10:32," is printed on the partition sheet 41. In hardware terms, this printing is executed by the CPU 21 receiving the signal from the clock 11, creating image data corresponding to the display "10:32," and the printing unit 14 developing these image data, similar to that described in [2-1] above.

By repeating the same operation as described above, partition sheets 41, 42, and so on, on which the time "10:32," "13:02," and so on, are printed are inserted between the printed documents 30 (FIG. 11). With the help of the time printed on these partition sheets, users can easily find their own printed documents.

If the predetermined number is reached two or more times during the execution of a print job, after the print job is finished, only one partition sheet is printed and discharged by the printing unit 14 and the sheet transport unit 15. For example, in the example shown in FIG. 9, if it is assumed that the 100th and 150th sheets of printed document were discharged during execution of a single print job, then a partition sheet with "13:50" would be printed, but a partition sheet with "13:02" would not be printed.

Also, as above, the predetermined number "50," in other words printing a partition sheet every 50 sheets, is just an example. Depending on the conditions of use of the printing apparatus 10, it may be desirable to increase or to decrease the predetermined number. Therefore the partition unit 13 may be configured so that the predetermined number can be changed in accordance with users' instructions input via the touch panel 16.

In a printing apparatus in which partition sheets are discharged in accordance with the time, as described in [2-1] above, even if the number of sheets discharged is large, a partition sheet will not be discharged until the predetermined time has arrived. Therefore, this printing apparatus has the advantage that when many sheets are discharged, a large number of partition sheets is not consumed in a short period of time.

On the other hand, with a printing apparatus in which partition sheets are discharged in accordance with the number of sheets discharged, as in the present example, for as long as the predetermined number of sheets discharged is not reached, a partition sheet is not discharged, regardless of how much time has passed. Therefore, this printing apparatus has the advantage that when the number of sheets discharged is comparatively few, consumption of sheets as partition sheets is prevented. Also, when the number of sheets discharged is comparatively few as in this case, the users are not as inconvenienced even if partition sheets are not discharged. This is because when there are no printed documents there is no need for partition sheets, and when the number of sheets of printed documents in the sheet discharge tray 7 is small, users can easily find their own requested print jobs even without partition sheets. Therefore there is no need for partition sheets. Specifically, according to the configuration of the present example, in a case in which in the morning only about 10 sheets of printed documents are printed, and no partition sheets are discharged, then in the afternoon when many sheets of printed documents are printed, partition sheets are printed and discharged, consumption of partition sheets can be avoided.

In FIG. 3A, only one sheet discharge tray 7 is shown, but the printing apparatus 10 may have two or more sheet discharge trays 7. If the printing apparatus 10 is provided with two or more sheet discharge trays 7, the sheet discharge unit 153 may be formed with branches corresponding to each sheet discharge tray 7, and the CPU 21 may control the discharge of sheets to a sheet discharge tray 7 specified by a user. Also, the counter 12 may count the number of sheets of printed documents discharged to each sheet discharge tray 7. Further, the partition unit 13 may control the printing unit 14 and the sheet transport unit 15 so that a partition sheet is discharged to a sheet discharge tray 7 for which the number of sheets discharged has reached the predetermined number. In other words, the partition unit 13 may be configured to instruct the discharge of a partition sheet in accordance with the number of sheets discharged, for every sheet discharge tray 7.

In a case in which a plurality of sheet discharge trays 7 is provided, the printing apparatus may be configured so that a sensor 8 is provided on each branch of the sheet discharge unit 153, and the counter 12 counts the number of sheets discharged to each sheet discharge tray 7 from the output values of each sensor 8. Alternatively, the counter 12 may detect how many sheets have been discharged to each sheet discharge tray 7 from the sheet discharge operations of each branch of the sheet discharge unit 153, such as the number of revolutions of the sheet discharge rollers, or the like, and so count the number of sheets discharged to each individual sheet discharge tray 7.

Also, when a plurality of sheet discharge trays 7 is provided, the counter 12 may obtain the number of sheets discharged to each sheet discharge tray 7 from the details of the instructions from each user, and other information regarding each individual print job held by the CPU 21.

In order to discharge a partition sheet every time the predetermined number of discharged sheets has been reached, the printing apparatus 10 may determine whether the results of the count obtained by the partition unit 13 from the counter 12 has reached the predetermined number or not, or the counter 12 may be set to notify the partition unit 13 that the predetermined number has been reached, every time the predetermined number has been reached.

[2-3] When Partition Sheets are Discharged in Accordance with the Time and the Number of Sheets Discharged Next, a case in which the two kinds of condition described in [2-1] and [2-2] above are used in combination as the condition of partitioning, in other words, when a predetermined time has arrived and when a predetermined number of sheets discharged has been reached, is described.

In the present example, the printing apparatus 10 controls the printing unit 14 and the sheet transport unit 15 so that a partition sheet is printed and discharged based on the time of the clock 11 and the count result of the counter 12. Apart from the programming of the partition unit 13, the configuration is virtually the same or the same as the configuration described under [2-1] and [2-2] above.

Figure 12:
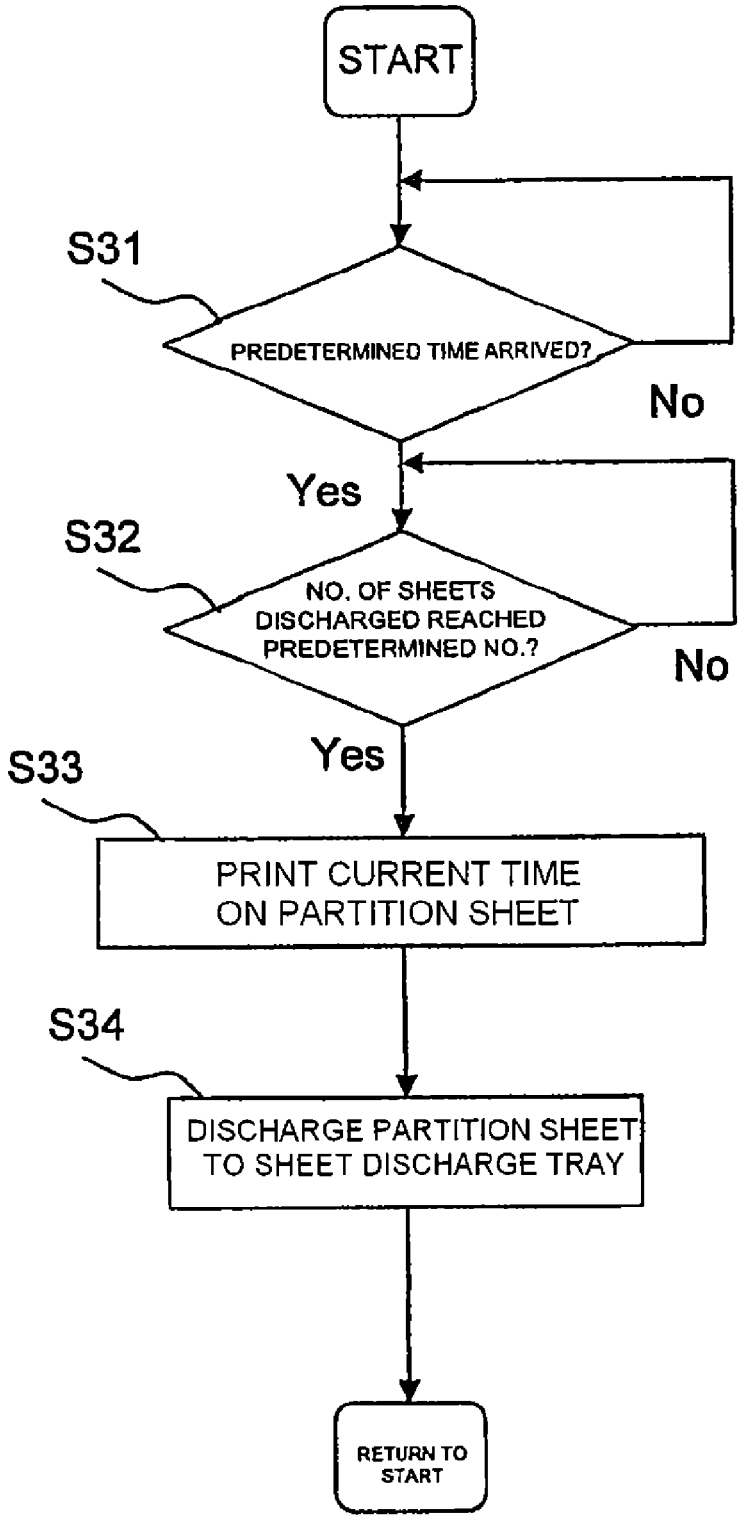
FIG. 12 is a view of a flowchart showing yet another example of the partition operation.
Figure 13:
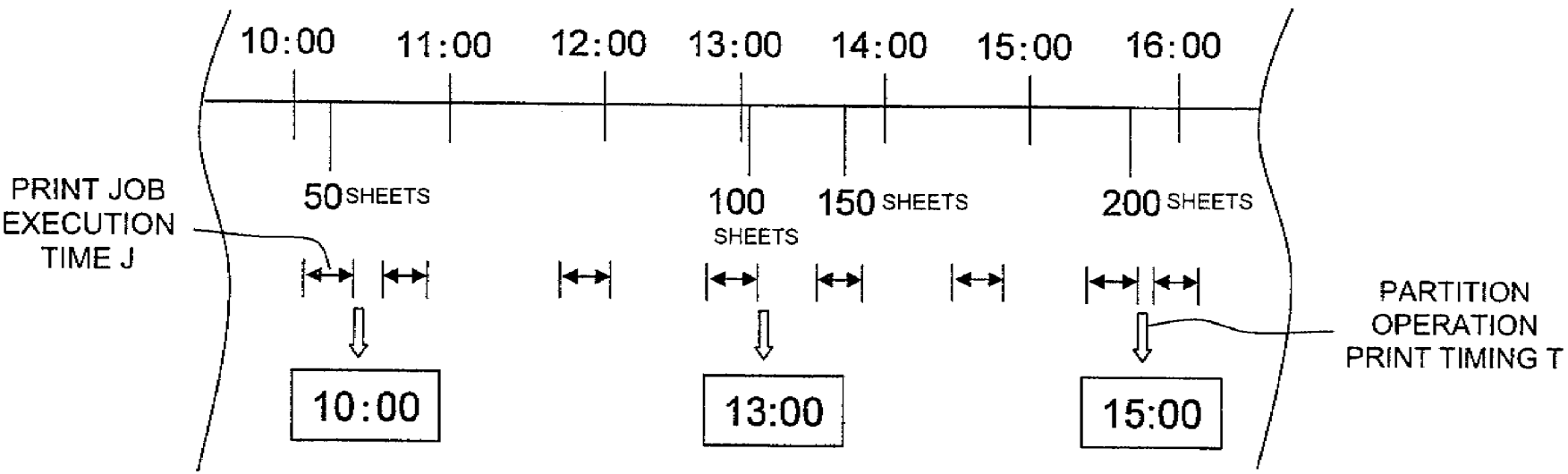
FIG. 13 is a view of a diagram showing the timing of execution of printing the partition sheet in the example of FIG. 12.

The partitioning operation in the present example is explained in detail with reference to FIGS. 12 and 13. FIG. 12 is a view of a flowchart showing the partitioning operation in the present example. FIG. 13 is a view of a diagram showing the timing of execution of printing the partition sheet in the present example. Along the time axis in FIG. 13, the timing of execution of print jobs J, the timing of printing of partition sheets T, the time of printing partition sheets, and the cumulative numbers of sheets discharged are shown, similar to FIG. 9. In FIG. 13, the state of use of the printing apparatus 10 is the same or substantially the same as the example in FIG. 5.

First, the partition unit 13 determines whether the predetermined time has arrived based on the time measured by the clock 11 (Step S31). Also, if the predetermined time has not arrived (Step S31: NO), the partitioning operation is not carried out.

On the other hand, if it is determined that the predetermined time has arrived, the partition unit 13 determines whether the predetermined number of sheets have been discharged based on the count result of the clock 12 (Step S31: YES→Step S32). If the predetermined number of sheets discharged has not been reached (Step S32: NO), the partitioning operation is not carried out. On the other hand, if it is determined that the predetermined number of sheets discharged has been reached, the partition unit 13 controls the printing unit 14 and the sheet transport unit 15 to print and discharge a partition sheet (Step S32: YES→Step S33→Step S34). At this time, the predetermined time immediately prior to the time when the predetermined number of sheets discharged was reached is printed on the sheet that is to become the partition sheet.

Here it is assumed that the predetermined times are 9:00, 10:00, 11:00, 12:00, and so on, at one hour intervals, and that the predetermined number of sheets discharged is 50. As shown in FIG. 13, when 10:00 arrives, the cumulative number of discharged sheets is less than 50, so unlike the example in

[2-1] above, a partition sheet is not produced. Also, when the cumulative number of sheets discharged reaches 50 after 10:00, the partition operation is executed immediately after the print job that is being executed at that time is finished. In this partitioning operation, the printing unit 14 prints "10:00" on the sheet that is to become the partition sheet, unlike the example in [2-2] above.

Also, when the cumulative number of sheets discharged reaches 100 after 13:00, the partitioning operation is executed again. In this partitioning operation, the printing unit 14 prints "13:00" on the sheet that is to become the partition sheet. Subsequently, even though the cumulative number of sheets reaches 150 prior to 14:00, unlike the example in [2-2] above, the partitioning operation is not executed. In other words, if after one predetermined time has arrived, the predetermined number of sheets discharged is reached, the partitioning operation is executed once. However, even if before the next predetermined time arrives the predetermined number of sheets discharged is reached again, the partitioning operation is not executed.

Thereafter, at 14:00 and 15:00 the partitioning operation is not executed, but when the cumulative number of sheets discharged reaches 200 after 15:00, the partitioning operation is executed. In this partitioning operation, the printing unit 14 prints "15:00" on the sheet that is to become the partition sheet.

As a result of the operation described above, partition sheets on which "10:00," "13:00," and "15:00" are printed are inserted between the printed documents 30. Therefore, with the help of the time printed on the partition sheets, users can find their own printed documents.

In this way, by determining whether the partitioning operation is necessary or not by the above two kinds of condition linked (by an AND operator) in series, the partition unit 13 does not discharge partition sheets when the number of sheets of printed documents discharged by the printing apparatus is comparatively small. However, the partition unit 13 also does not discharge partition sheets when the number of sheets of printed documents discharged is comparatively large if the predetermined time has not arrived. In other words, according to the configuration of the present example, it is possible to prevent unnecessary consumption of partition sheets when the number of sheets printed is small. In addition, it is possible to prevent consumption of a large number of partition sheets when the number of sheets printed is large.

[2-4] Other Examples of Timing of the Partitioning Operation

In [2-1] through [2-3] above, when each partitioning condition is satisfied, or, if there is a print job being executed at that time, immediately after the print job is finished, the printing unit 14 and the sheet transport unit 15 are controlled by the partition unit 13 to execute the partitioning operation. However, the timing of execution of the partition operation is not limited to this, and the timing may be in the first interval between print jobs after each partition condition has been fulfilled. In other words, if there is no print job being executed at the time that the partition conditions are fulfilled, the partition operation may be immediately executed. If there is a print job being executed at the time that the partition conditions are fulfilled, the partition operation may be executed anytime after finishing the print job until the next job is executed, or the partition operation may be executed when the first page of the next print job is being printed.

Executing the partition operation "when the first page of the next print job is being printed" means that the printing apparatus 10 uses the first page of the printed document of the first print job after the partitioning conditions have been satisfied as the partition sheet. In other words, the printing unit 14, in accordance with an instruction to execute the partitioning operation from the partitioning unit 13, may print the predetermined time or the time of printing on the sheet that is used as the first sheet of the first print job, after the partitioning conditions are satisfied. In this way, it is possible to further economize on paper by using the normal printed document as a partition sheet. In this case, the partitioning conditions may be any of the conditions described in [2-1] through [2-3] above.

Figure 14:
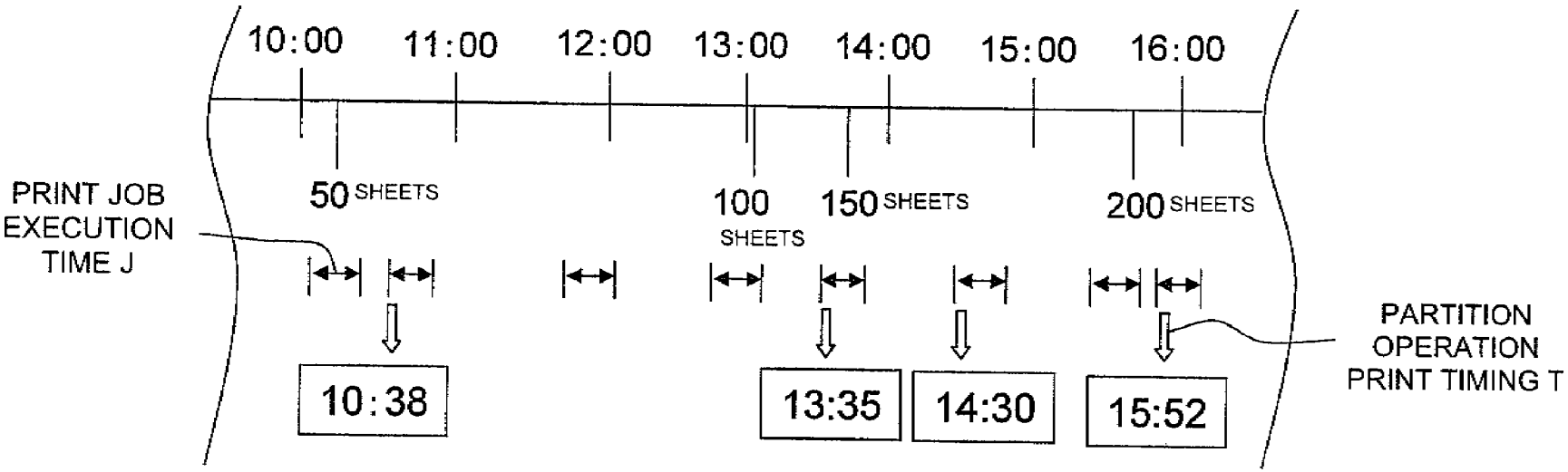
FIG. 14 is a view of a diagram showing the execution timing of printing the partition sheets, when using the first sheet of the sheets used in the print job as the partition sheet.
Figure 15:
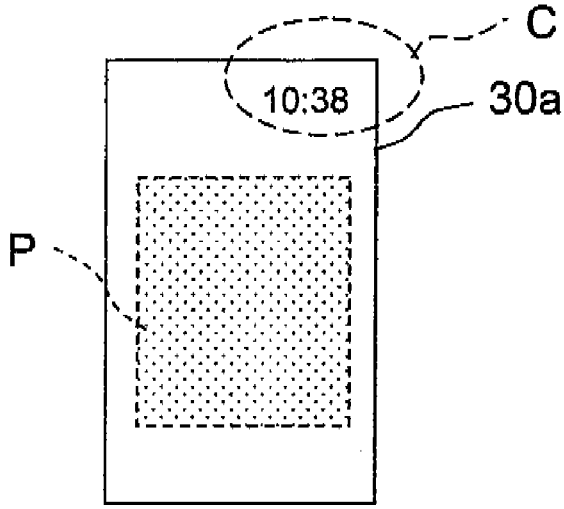
FIG. 15 is a view of a diagram showing the second side of the sheet on which the time is printed.
Figure 16:
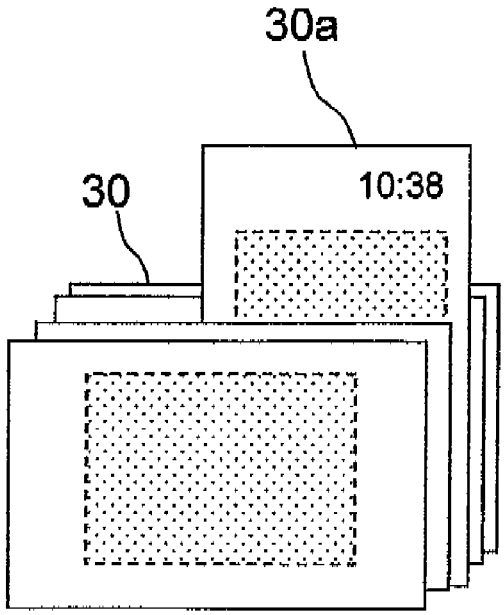
FIG. 16 is a view of a diagram showing another example of a bundle of sheets that includes normal printed documents with partition sheets inserted between documents, in the sheet discharge tray, printed at the timing shown in FIG. 14.

The following is an explanation of a specific example of a partitioning operation using the first page of a document as the partition sheet, with reference to FIGS. 14 through 16. In this example, the partitioning condition is when the number of sheets discharged reaches the predetermined number, the same as in [2-2] above, and the time printed on the partition sheet is the time when the partitioning operation was executed. In FIG. 14, the state of use of the printing apparatus 10 is the same or substantially the same as the example in FIG. 5.

As shown in FIG. 14, while the first print job is being executed, the number of sheets discharged reaches 50. After this print job is finished, the printing unit 14 and the sheet discharge unit 15 print the first side of the first sheet of the next print job. Then, using the reversal unit 154, on the second side of the sheet the current time "10:38" is printed, as shown within the circle C indicated with a broken line on FIG. 15.

As shown in FIG. 16, the sheet discharge unit 153 turns the partition sheet 30*a* printed in this way through 90 degrees relative to the other printed documents 30, and discharges the partition sheet to the sheet discharge tray 7, the same as described for [2-1] above.

In FIGS. 15 and 16, the second side of the partition sheet 30*a* printed in this way is facing towards us. However, for convenience of explanation the image on the first side is indicated with dotted lines.

In the above, the sheet transport unit 15 discharges printed documents to the sheet discharge tray 7 with the first side facing down, starting with the first page. In contrast, if the sheet transport unit 15 discharges the sheets to the sheet discharge tray 7 with the first side facing up, and in the order from the last page to the first page, then when executing the partition operation the printing unit 14 and the sheet transport unit 15 may print the predetermined time or the current time on the first side of the sheet that will become the last page, and discharge the sheet to the sheet discharge tray 7 as the partition sheet.

Figure 17:
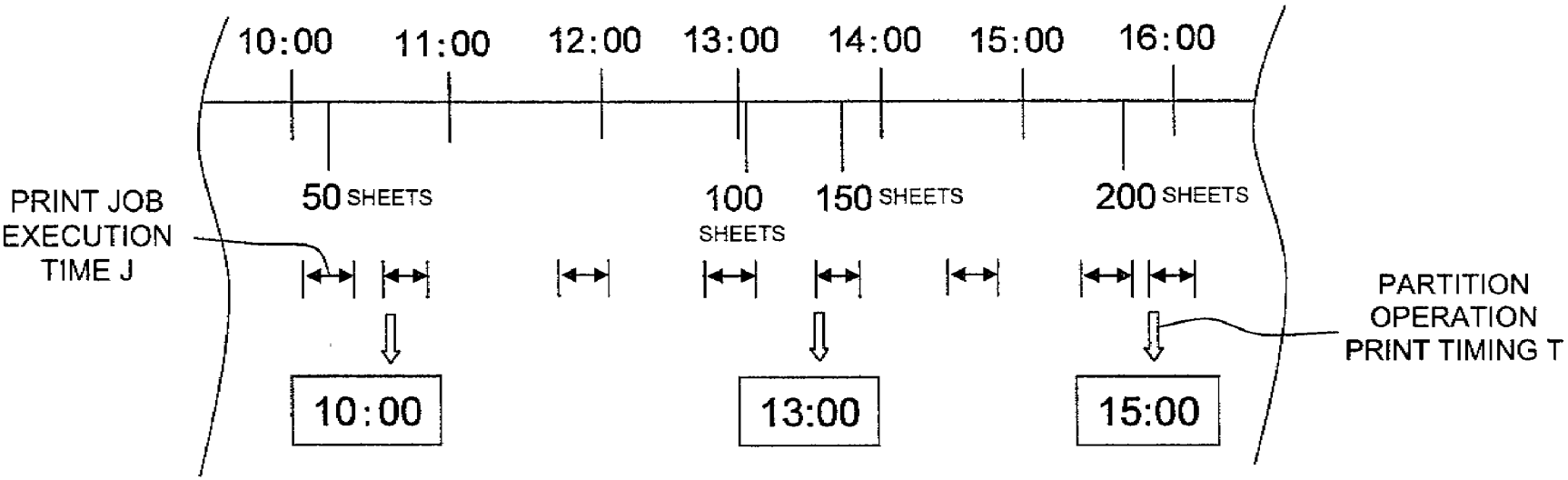
FIG. 17 is a view of a diagram showing another example of the execution timing of printing the partition sheets, when using the first sheet of the sheets used in the print job as the partition sheet.
Figure 18:
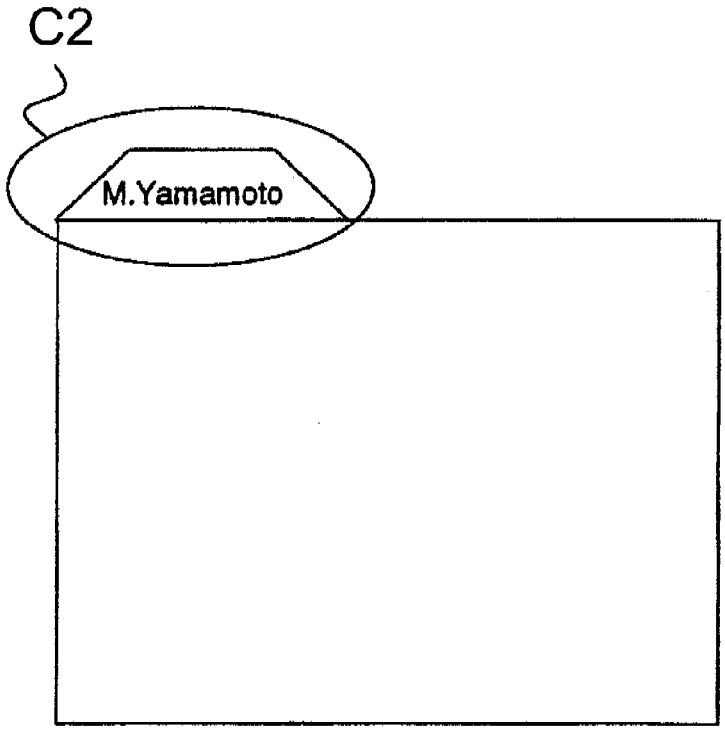
(Prior Art) FIG. 18
FIG. 18 is a view of a diagram showing a tab used in a conventional image forming apparatus.
Figure 19:
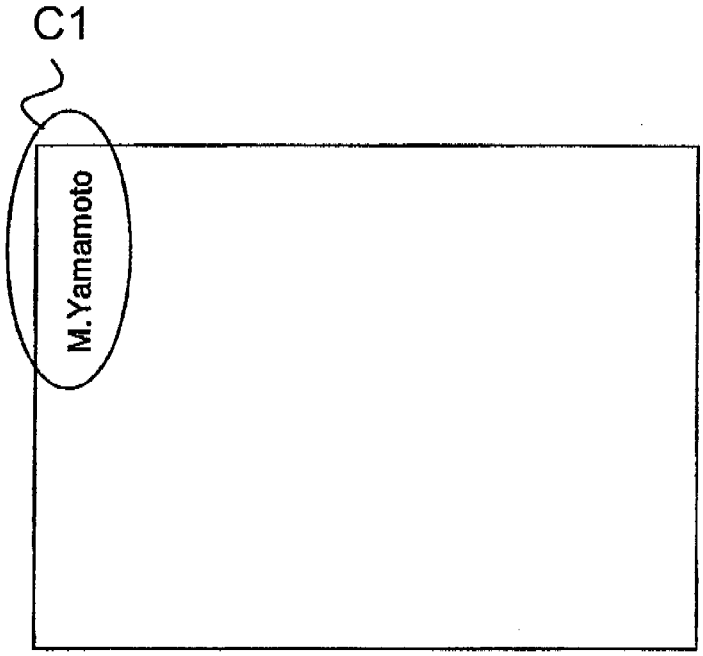
(Prior Art) FIG. 19
FIG. 19 is a view of a diagram showing an index used in a conventional image forming apparatus.

FIG. 17 shows the timing of printing the partition sheet for the case where the partitioning condition is the arrival of the predetermined time and reaching the predetermined number of sheets discharged, the same as for [2-3] above. In FIG. 17, the state of use of the printing apparatus 10 is the same as the example in FIG. 5. In this example, as shown in FIG. 17, the predetermined times "10:00," "13:00," and "15:00" are printed on the first sheet of the printed document of the first job after the partition conditions are fulfilled.

[3] Other Examples of Partition Operation

In [2] described above, the partition operation was made of the printing unit 14 printing the time on a sheet, and the sheet transport unit 15 transporting the sheet on which the time is printed to the sheet discharge tray 7 as the partition sheet. However, the present invention is not limited to this, provided the partitioning operation includes at least discharging a partition sheet to the sheet discharge tray 7. In other words, in the partitioning operation, the time does not necessarily have to be printed on the partition sheet. Instead of the time, a number that expresses the order of discharging, or similar, may be used. However, printing the time has the effect that it is easy for the user to find the target printed document.

Also, as is apparent from the explanations in [1] through [3] in this disclosure above, the image forming apparatus in (1) through (5) below can be included as embodiments of the present invention.

(1) An image forming apparatus that includes a printing unit that executes print jobs; a sheet discharge unit that discharges sheets to the sheet discharge tray after printing; a counter that counts the number of sheets discharged by the sheet discharge unit; a clock that measures the time; and a partition unit that instructs the printing unit to print partition sheets between print jobs, based on a predetermined partitioning condition can be included.

(2) The image forming apparatus as described in (1) above, in which the partitioning condition is the arrival of a predetermined time, and the predetermined time is printed on the partition sheet.

(3) The image forming apparatus as described in (1) above, in which the partitioning condition is the discharge of a predetermined number of printed sheets, and the time of printing is printed on the partition sheet.

(4) The image forming apparatus as described in (1) above, in which the partitioning condition is the arrival of a predetermined time and the discharge of a predetermined number of printed sheets, and the predetermined time is printed on the partition sheet.

(5) An image forming apparatus as described in any of (1) through (4) above, in which the sheet discharge unit displaces the position of the partition sheets relative to the printed sheets when discharging.

The present invention is not limited to the embodiments described above. Many types of change can be made within the scope indicated in the claims, and embodiments obtained by combining as appropriate the technical means disclosed in different embodiments are also included within the technical scope of the present invention.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having" and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming apparatus of the present invention. Accordingly, these terms, as utilized to describe the present invention should be interpreted relative to an image forming apparatus of the present invention as normally used. Finally, terms of degree such as "virtually," "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus, comprising:
- a printing unit being configured to execute print jobs including printing images on sheets;
- a sheet discharge tray configured to receive the printed sheets and partition sheets configured to partition the printed sheets;
- a transport unit configured to discharge the printed sheets and the partition sheets to the sheet discharge tray;
- a clock configured to measure time; and
- a partition unit configured to control the transport unit to discharge a partition sheet to the sheet discharge tray during a first interval between print jobs only after a predetermined time based on measurement results of the clock.

2. The image forming apparatus according to claim 1, wherein the transport unit discharges the partition sheets so that a position in the sheet discharge tray of the partition sheets is displaced relative to a position in the sheet discharge tray of the sheets on which images were printed in print jobs.

3. The image forming apparatus according to claim 1, wherein the partition unit controls the printing unit to print a predetermined time on the partition sheets.

4. The image forming apparatus according to claim 3, wherein the printing unit prints the predetermined time on a sheet used in a print job as a partition sheet, and the transport unit discharges the sheet on which the predetermined time is printed to the sheet discharge tray as the partition sheet.

5. The image forming apparatus according to claim 2, wherein the partition sheets are displaced ninety degrees relative to the printed sheets.

6. The image forming apparatus according to claim 1, further comprising a counter that counts the number of sheets discharged to the sheet discharge tray, wherein the partition unit controls the transport unit to discharge the partition sheet to the sheet discharge tray during the first interval between print jobs after a predetermined number of sheets discharged has been reached after the predetermined period of time.

7. The image forming apparatus according to claim 6, wherein the partition unit controls the printing unit to print a predetermined time on the partition sheet.

8. An image forming apparatus, comprising:
- a printing unit configured to execute print jobs by printing images on sheets to produce printed sheets;
- a sheet discharge tray configured to receive the printed sheets and partition sheets partitioning the printed sheets;
- a transport unit configured to discharge the printed sheets and the partition sheets to the sheet discharge tray;
- a counter configured to count the number of sheets discharged to the sheet discharge tray;
- a clock configured to measure time; and
- a partition unit configured to control the printing unit to print a current time on a first sheet used in a first print job after measurement results of the counter reach a predetermined number and only after arrival of a predetermined time, wherein the partition unit controls the printing unit to cancel printing the current time if the measurement results of the counter reach the predetermined number two or more times before a next predetermined time.

9. An image forming apparatus, comprising:

a printing unit configured to execute print jobs by printing images on sheets to produce printed sheets;

a sheet discharge tray configured to receive the printed sheets and partition sheets partitioning the printed sheets;

a transport unit configured to discharge the printed sheets and the partition sheets to the sheet discharge tray;

a counter configured to count the number of sheets discharged to the sheet discharge tray;

a clock configured to measure time; and a partition unit configured to control the printing unit to print a predetermined time on a first sheet used in a first print job after measurement results of the counter reach a predetermined number and only after arrival of a predetermined time, wherein the partition unit controls the printing unit to cancel printing the predetermined time if the measurement results of the counter reach the predetermined number two or more times before a next predetermined time.

* * * * *